United States Patent [19]

Tracy

[11] 4,150,464

[45] Apr. 24, 1979

[54] BUCKLE

[75] Inventor: Richard J. Tracy, Elgin, Ill.

[73] Assignee: Illinois Tool Works Inc., Chicago, Ill.

[21] Appl. No.: 823,227

[22] Filed: Aug. 10, 1977

[51] Int. Cl.[2] ..... A44B 11/25

[52] U.S. Cl. ..... 24/77 R; 24/230 R; 24/196

[58] Field of Search ..... 24/230 AS, 230 R, 77 R

[56] References Cited

U.S. PATENT DOCUMENTS

| | | | |
|---|---|---|---|
| 1,429,155 | 9/1922 | Metcalf | 24/230 R |
| 2,840,878 | 7/1958 | Olson | 24/230 R |
| 3,181,189 | 5/1965 | Leyden | 24/230 R |
| 3,798,711 | 3/1974 | Cousins | 24/230 R |
| 3,967,351 | 7/1976 | Rosenberg | 24/230 R |
| 3,979,934 | 9/1976 | Isenmann | 24/230 R |

FOREIGN PATENT DOCUMENTS

| | | | |
|---|---|---|---|
| 676151 | 2/1930 | France | 24/230 R |
| 1146568 | 3/1969 | United Kingdom | 24/230 R |

*Primary Examiner*—Bernard A. Gelak

*Attorney, Agent, or Firm*—Jack R. Halvorsen; Robert W. Beart

[57] ABSTRACT

A buckle includes separable cooperating receptacle and clasp members. The receptacle member includes a pair of locking slots formed in opposing sides thereof. The clasp member includes a pair of resilient arms having locking tabs thereon for releasably engaging the locking slots of the receptacle member. The receptacle member also includes a pair of grooves for slidably engaging cooperating raised ridges formed on a central arm of the clasp member for guiding said clasp member during insertion into and removal from the receptacle member. The central arm of the clasp member also includes a pair of laterally extending edges for defining a limit to the inward bending of the resilient arms. The receptacle also includes a belt end termination member including a slide member for adjusting the length of a belt looped around said slide member. The clasp member also includes a base member joining the three arms thereof and including a through slot for terminating a belt end or the like.

8 Claims, 7 Drawing Figures

BUCKLE

BACKGROUND OF THE INVENTION

This invention relates generally to a buckle, and more particularly to a buckle for releasaby joining two ends of a belt or the like and including means for adjusting the length of the belt, at least at one of the two belt ends thus joined.

The buckle of this invention comprises a separable coupling device of relatively simple yet reliable design, suitable for releasably connecting and holding or otherwise joining or assembling two members to be united, such as strips of material, straps, wires, belts or the like, and further adapted for permitting adjustment of the overall length of the member once joined thereby. As a specific example, to which no limitation is intended, the buckle of this invention may be utilized for connecting the straps or belts of a life jacket, back pack or the like, wherein it is desirable to securely and yet releasably couple the belts or straps and also to provide for an adjustable overall length thereof.

Accordingly, it is a general object of this invention to provide a new and improved buckle for releasably coupling two ends of a belt or the like and adapted to adjust the length of said belt, at least at one of said ends.

Another object of this invention is to provide a buckle in accordance with the foregoing object, which is simple yet reliable in operation and comprising relatively few parts of relatively simple design to facilitate simple and inexpensive manufacture thereof.

Yet another object of this invention is to provide a buckle in accordance with the foregoing objects, adapted to be readily molded or otherwise formed from a relatively light weight material and to be rugged and reliable in operation.

Briefly, and in accordance with the foregoing objects, a buckle according to this invention comprises separable cooperating receptacle and clasp members. The receptacle member includes guide means for guiding the clasp member to be inserted therein and means for releasably coupling said clasp member thereto including locking-slot means. The clasp member includes cooperating guide means for slidably engaging the guide means of the receptacle member, a pair of resilient arms including locking tab means for releasably engaging said locking slot means of said receptacle member and stop means for defining a limit of bending of the resilient arms, to substantially prevent overbending thereof during insertion into or removal from said receptacle member.

Other objects, features and advantages of the invention will be more readily appreciated upon consideration of the following detailed description, together with the accompanying drawings, wherein like reference numerals are used throughout to designate like elements and components.

BRIEF DESCRIPTION OF THE DRAWINGS

FIG. 1 is a perspective view of a buckle constructed in accordance with this invention in a coupled condition, in conjunction with a pair of ends of a belt or the like;

DETAILED DESCRIPTION OF THE ILLUSTRATED EMBODIMENT

Figure 1:
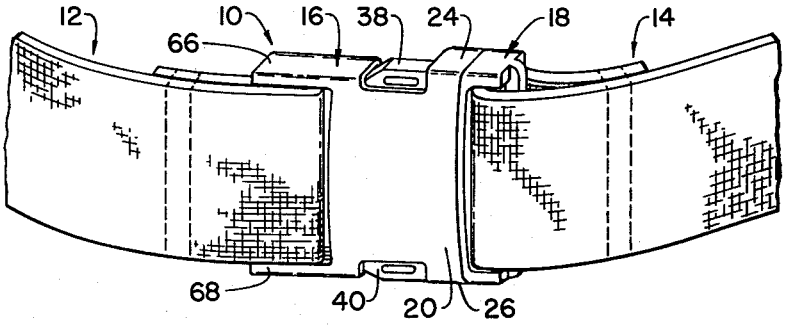

Referring to the drawings, a buckle 10, constructed in accordance with this invention is illustrated for coupling together a pair of ends 12 and 14 of a belt or the like. The buckle 10 includes separable cooperating receptacle member 16 and a clasp member 18 both preferably molded from a tough resilient plastic material such as nylon or Delrin. The receptacle member 16 and the clasp member 18 each include cooperating coupling or locking means for releasably coupling the clasp and receptacle members. The receptacle member 16 comprises a generally flat tubular body having relatively wider side walls 20 and 22, relatively narrower top and bottom walls 24 and 26 and an end opening 28 for receiving the clasp member 18. The locking or coupling means of the receptacle 16 includes a pair of through slots 30 and 32, formed in facing relation in the top and bottom walls 24 and 26. It will be noted that the sides of the slots 30 and 32 extend into the respective side walls 20 and 22 for a minor fractional part thereof, and are spaced apart from the end opening 28.

The clasp member 18 includes a pair of resilient arms 34 and 36 and an end or base portion 37 joining the arms 34 and 36. The arms are spaced apart by substantially the extent of the end opening 28 between the top and bottom walls 24 and 26 of the receptacle 16. A pair of locking tab means comprising raised edge portions 38 and 40 formed at leading edges of the arms 34 and 36 are spaced apart somewhat in excess of the extent of the opening 28. The raised edge portions 38 and 40 decrease in widths towards the leading edge thereof to define a pair of ramps 42 and 44 thereon. Leading edges of said ramps are spaced apart a distance somewhat less than the extent of the opening 28 between the walls 24 and 26 of the receptacle 16. The raised portions 38 and 40 of the arms 34 and 36, including the leading ramp portions 42 and 44 thereof are substantially equal in length to the lengthwise extent of the slots 30 and 32 of the receptacle 16.

It will be appreciated from the foregoing description, that the clasp member 18 may be readily inserted into the open end of the receptacle 16, the leading edges of the ramps 42 and 44 thereof slidingly engaging the inner sides of the top and bottom walls 24 and 26. The resilient arms 34 and 36 are adapted to flex inwardly as the clasp 18 is inserted into the receptacle 16 in the direction indicated by the arrows 46. Thus, as the trailing ends of the raised portions 38 and 40 reach the slots 30 and 32 thereof, the resilient arms spring or snap back to their original configuration, locking the tabs comprising the raised portions 38 and 40 within the slots 30 and 32, so as to prevent removal of, or motion of, the clasp member 18 in the direction opposite the arrows 46.

Figure 4:
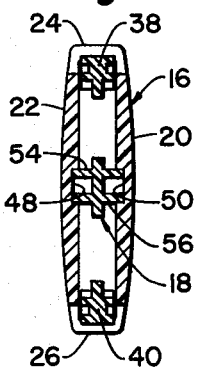
FIG. 4 is a view taken generally along the line 4—4 of FIG. 3.
Figure 6:
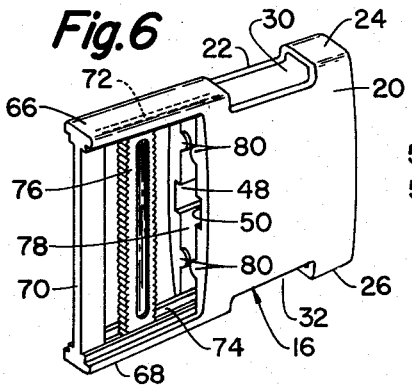
FIG. 6 is a perspective view of a portion of the buckle of FIGS. 1-3.
Figure 7:
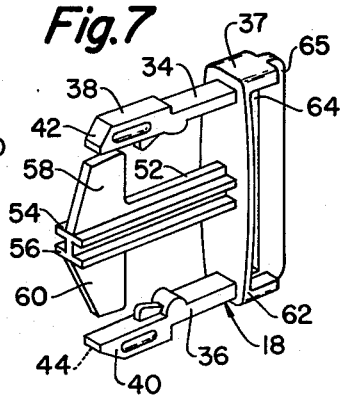
FIG. 7 is a perspective view of another portion of the buckle of FIGS. 1-3.

As best seen in FIGS. 4 and 6, the receptacle 16 includes a pair of grooves 48 and 50 formed in facing relation on the inner sides of the walls 20 and 22 and extending substantially the length of said walls midway between the top and bottom walls 24 and 26. As best seen in FIGS. 4 and 7, the clasp member 18 includes a relatively rigid arm 52, located substantially midway between and of substantially the same length as the resilient arms 34 and 36. The rigid arm 52 includes a pair of ridges 54 and 56 extending laterally outwardly of opposite sides thereof and spaced apart by substantially the width of the grooves 48 and 50. The ridges 54 and 56 are adapted for slidably engaging the grooves 48 and 50, defining therewith cooperating guide means for guiding the clasp 18 into the receptacle 16. The cooperation of the ridges 54 and 56 with the grooves 48 and 50 is such as to substantially limit the relative motion between the clasp 18 and receptacle 16 upon either insertion or removal of the clasp 18, to the plane of the arrows 46 of FIG. 2.

Figure 2:
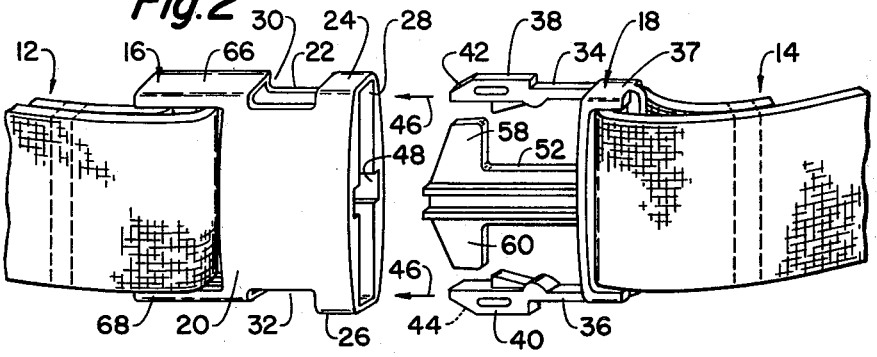
FIG. 2 is a view similar to FIG. 1 of a buckle according to this invention in its opened or uncoupled condition.
Figure 3:
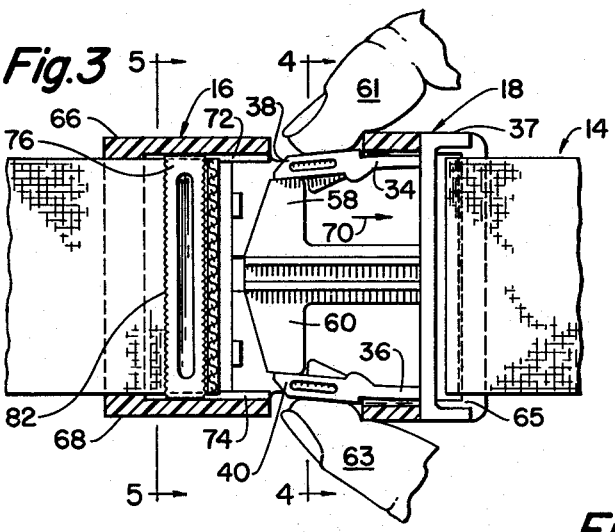
FIG. 3 is a side elevational view, partially cutaway, of the buckle of FIGS. 1 and 2 in a coupled condition, and illustrating the uncoupling thereof.

As best seen in FIGS. 2,3, and 7, the rigid arm 52 also includes a pair of laterally outwardly projecting wing-like edge members 58 and 60, which project toward the resilient arms 34 and 36, and are spaced inwardly therefrom. It will be noted that the end surfaces of the projecting edge parts 58 and 60 are angled somewhat, as best seen in FIG. 3, for limiting the inward bending of the resilient arms 34 and 36 to the extent necessary for insertion or removal with respect to the receptacle 16. It will be further noted that the base or end member 37 of the clasp 18 includes an outwardly extending ridge 62 formed therearound, of greater dimension generally than the length and width of the opening 28 of the receptacle 16, for defining the limit of insertion, in the direction indicated by the arrows 46, of the clasp 18 into the receptacle 16. The limit of insertion corresponds generally to the point at which the locking tabs 38 and 40 engage the slots 30 and 32, as best seen in FIGS. 1 and 3.

From the foregoing description, and with reference to FIG. 3, the method of releasing the locking tabs 38 and 40 from the slots 30 and 32 for removal of the clasp 18 from the receptacle 16 will become apparent. As illustrated by the fingers 61, 63, inward pressure upon the resilient arms 34 and 36 and particularly at the raised portions or locking tabs 38 and 40 thereof, results in the arms 34 and 36 moving inwardly to engage the wing-like projecting edge portions 58 and 60 of the rigid arm 52. It will be noted that the lateral extent of the slots 30 and 32 into the side walls 20 and 22 of the receptacle facilitates accessability to the tabs 38 and 40 for this purpose. With the tabs 38 and 40 in engagement with the edge portions 58 and 60 of the arm 52, as illustrated in FIG. 3, the distance between the tabs is somewhat less than the distance between the top and bottom walls 24 and 26 of the receptacle, whereby the clasp 18 may be readily removed therefrom by sliding in a direction indicated by the arrow 70.

Referring again to FIG. 6 and FIG. 7 it will be noted that the receptacle 16 and clasp 18 each include means for attachment to an end of a belt or the like, such as the belt ends 12 and 14 of FIGS. 1–3. The belt attachment means of the clasp 18 includes a through slot 64 formed in a trailing edge section 65 of the base or end portion 37 thereof. A belt end such as the end 14 may be looped through the slot 64 and around the section 65, as illustrated in FIGS. 1 and 2, and sewn or otherwise attached to the belt, for permanent attachment to the clasp member 18.

The belt retaining means associated with the receptacle 16, includes a pair of arms 66 and 68 extending outwardly from the trailing end of, and substantially in the same place as the slots 30 and 32, respectively. The arms 66 and 68 terminate in a cross member 70 joining said arms. A pair of grooves 72 and 74 are formed in the arms 66 and 68, respectively extending substantially along the length thereof from the slots 30 and 32 to the cross member 70. A slide member 76 comprises an elongate substantially rectangular member having opposite ends thereof slidably engaged in the respective slots or grooves 72 and 74.

Figure 5:
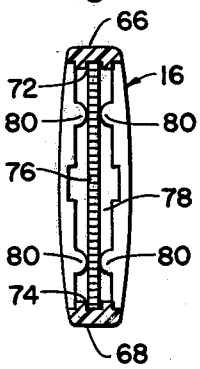
FIG. 5 is a view taken generally along the line 5—5 of FIG. 3.

Referring to FIG. 6, it will be seen that the receptacle 16 includes a second open end 78 opposite the open end 28 thereof and extending between the arms 66 and 68 at the ends thereof opposite the cross member 70. A plurality of parts or tabs 80 integral with the side walls 20 and 22 of the receptacle 16 project inwardly into the opening 78. The projecting tabs 80 define openings therebetween generally narrower in width than the width of the slide member 76, whereby the tabs 80 are engable with member 78 to provide a stop to limit the sliding motion thereof in the grooves 72 and 74, in the direction of the opening 78, as best seen in FIG. 5. The tabs 80 are resiliently supported by the walls 20 and 22 to permit the initial insertion of the slide member 76 into the grooves 72 and 74 from the direction of the opening 78.

It will be appreciated from the foregoing description that an end of a belt or the like such as the belt end 12 of FIGS. 1 through 3 may be looped around the slide member 76, and the length thereof adjusted by holding the slide member 76 away from the end or cross member 70. When the slide member 76 is moved in the grooves 72 and 74 so as to hold the belt in engagement with the end wall or cross member 70, the belt will be retained therein thus defining an adjusted length thereof. The slide member 76 is also provided with a plurality of outwardly projecting teeth 82, as best seen in FIG. 3, for facilitating said engagement with the belt 12.

While a preferred embodiment has been shown and described herein it is not desired to limit the invention thereto. Changes and modifications therein may occur to those skilled in the art and possessed of the present disclosure, and such changes form a part of this invention insofar as they fall within the spirit and scope of the appended claims.

The invention is claimed as follows:

1. A buckle comprising separable cooperating receptacle and clasp members, said receptacle member including a generally flat tubular body having relatively wider side walls and relatively narrower top and bottom walls, an opening at one end of said body for receiving said clasp member, and locking slot means including a pair of through slots formed in opposed facing relation in said top and bottom walls and spaced apart from said opening at said one end a predetermined distance, said clasp member including a base member and a pair of resilient arms extending outwardly from opposite ends of said base member, each of said resilient arms including locking tab means for releasably engaging said locking slot means of said receptacle means, said locking tab means of said clasp member including raised edge portions at leading ends of said resilient arms adapted to be cooperatively accepted by said through slots and spaced apart in excess of said top and bottom walls of said receptacle for displacing said arms during insertion in said receptacle member and for snappingly engaging said through slots when passing therethrough, guide means for guiding said clasp member for insertion into and removal from said receptacle member, said guide means including a pair of facing elongated groove means carried by said side walls of said receptacle member and a rigid third arm medially disposed between said resilient arms on said clasp member having means thereon for slideably engaging said grooves, said third arm connected at one end to said base and stop means extending laterally from adjacent the opposite end of said third arm and terminating in normally spaced relation to said locking tab means to define a limit of bending of said resilient arms to substantially prevent over bending thereof during insertion into or removal from said receptacle means.

2. A buckle according to claim 1 wherein said receptacle means and said clasp means each include means for attaching an end of a belt or the like thereto, at least one of said attaching means including means for selectively adjusting the length of the belt.

3. A buckle according to claim 2 wherein said belt end receiving means of said clasp member includes said base member joining said arms thereof and further including a through slot for receiving said belt end, a laterally extending abutment shoulder positioned adjacent said base member, said abutment shoulder defining the maximum extent of insertion of said clasp member into said receptacle member, said maximum insertion corresponding to the engagement between said raised edges of said resilient arms and said through slots of said receptacle member.

4. A buckle according to claim 1 wherein said belt length adjusting means of said receptacle member comprises a pair of arms, one arm extending outwardly from and substantially in the plane of each of said slots, an end member joining said arms at the end thereof opposite said slots, a pair of facing grooves formed in said arms, and located substantially centrally thereon extending from said slots to said end member, and a slide member slidably mounted in said slots and extending therebetween whereby said belt is looped around said slide member, the length thereof being adjustable when said slide member is spaced apart from said end member, and said slide member being slidable for engaging said belt against said end member to define an adjusted length of said belt.

5. A buckle according to claim 4 wherein said receptacle means includes means for defining the limit of motion of said slide member in the direction of said slots for retaining said slide member in said grooves.

6. A buckle according to claim 1 wherein said receptacle member groove means formed in said side walls in facing relation between said top and bottom walls thereof extends substantially the length of said side walls, and said clasp member rigid arm between said resilient arms includes a pair of oppositely projecting ridges spaced apart by substantially the width of said groove means for slideably engaging said groove means of said receptacle member to confine the relative motion between said clasp member and said receptacle member substantially to a single plane.

7. A buckle according to claim 1 wherein said locking slot means extends not only through said top and bottom walls but also extends into the adjacent side walls for a minor fractional portion thereof, with said slot means defining abutment edges for engagement by the raised locking tab means carried by said resilient arms of said clasp member.

8. A buckle according to claim 7 wherein said stop means includes a generally arrow-shaped member extending laterally from said third arm, said member having tapered outer extremities providing an angularly disposed abutment for engagement by said resilient arms when bent for insertion or removal from said receptacle.

* * * * *